US011383877B2

(12) United States Patent
Cornejo

(10) Patent No.: US 11,383,877 B2
(45) Date of Patent: Jul. 12, 2022

(54) HEAVY DUTY PACK AND METHOD OF MANUFACTURING

(71) Applicant: Carlos I. Cornejo, Irvine, CA (US)

(72) Inventor: Carlos I. Cornejo, Irvine, CA (US)

(73) Assignee: Innovative Packaging Solutions, Inc., Temecula, CA (US)

( * ) Notice: Subject to any disclaimer, the term of this patent is extended or adjusted under 35 U.S.C. 154(b) by 119 days.

(21) Appl. No.: 16/838,327

(22) Filed: Apr. 2, 2020

(65) Prior Publication Data

US 2020/0354101 A1 Nov. 12, 2020

Related U.S. Application Data

(60) Provisional application No. 62/845,587, filed on May 9, 2019.

(51) Int. Cl.

| | |
|---|---|
| ***B65D 33/06*** | (2006.01) |
| ***B65D 5/46*** | (2006.01) |
| ***B65D 33/08*** | (2006.01) |
| ***B65D 33/02*** | (2006.01) |

(52) U.S. Cl.

CPC ..... *B65D 5/46096* (2013.01); *B65D 33/02* (2013.01); *B65D 33/08* (2013.01)

(58) Field of Classification Search

CPC ..... B65D 5/46096; B65D 5/46008; B65D 5/4604; B65D 5/445; B65D 33/02; B65D 33/08; B65D 31/10; B65D 5/46032; B65D 33/06; B65D 75/56; B65D 75/566

USPC .... 229/117.14, 117.15, 199, 117.24, 117.25, 229/213, 249, 125.42, 117.26, 117.09, 229/117.23; 383/10, 15, 17, 20, 26, 120, 383/104, 7; 206/141, 162

See application file for complete search history.

(56) References Cited

U.S. PATENT DOCUMENTS

| | | | |
|---|---|---|---|
| 2,675,264 | A | 4/1954 | Lugt, Jr. |
| 2,933,232 | A | 4/1960 | Bugnone |
| 3,190,532 | A | 6/1965 | Marsh |
| 4,193,535 | A | 3/1980 | Griffith |
| 4,214,697 | A | 7/1980 | Manning |
| D267,474 | S | 1/1983 | Maroszek |

(Continued)

FOREIGN PATENT DOCUMENTS

| | | | | |
|---|---|---|---|---|
| KR | 200406708 | Y1 * | 1/2006 | |
| KR | 20100129468 | A * | 12/2010 | |
| WO | WO-2015111736 | A1 * | 7/2015 | ..... B31B 19/00 |

OTHER PUBLICATIONS

White Cardboard Gift Rectangular Box With Handle. [online] Retrieved Jun. 25, 2020 from URL: https://www.123rf.com/photo_33443609_stock-vector-white-cardboard-gift-rectangular-box-with-handle-vector-packaging-template-.html.

(Continued)

*Primary Examiner* — Jes F Pascua
*Assistant Examiner* — Nina K Attel
(74) *Attorney, Agent, or Firm* — Procopio Cory Hargreaves and Savitch LLP

(57) ABSTRACT

A heavy duty pack, comprising a main body including a front, a rear, a bottom, and opposite sides that join the front, the rear, and the bottom; a top section including a flat flange with a front panel and a back panel, and angled sections that join the main body to the flat flange. The flat flange includes opposite ends with respective seals adjacent thereto securing the front panel and the back panel together adjacent to the opposite ends.

14 Claims, 9 Drawing Sheets

(56) References Cited

U.S. PATENT DOCUMENTS

| | | | | |
|---|---|---|---|---|
| 5,611,626 | A * | 3/1997 | Warr | B65D 33/08 383/10 |
| 6,105,773 | A | 8/2000 | Miller | |
| 6,391,404 | B1 * | 5/2002 | Rosenbaum | A61J 1/05 428/35.2 |
| 6,808,105 | B2 * | 10/2004 | Lee | B65D 5/4608 229/117.09 |
| D509,442 | S | 9/2005 | Several | |
| 7,065,937 | B2 * | 6/2006 | Tankersley | B65B 9/20 53/131.5 |
| D685,633 | S | 7/2013 | Thomas | |
| D690,590 | S | 10/2013 | Fux | |
| D839,725 | S | 2/2019 | Ralston et al. | |
| 2009/0272663 | A1 | 11/2009 | Koch et al. | |
| 2011/0007985 | A1 * | 1/2011 | Getsy | B65D 33/06 383/12 |
| 2014/0185966 | A1 * | 7/2014 | Umenaka | B65D 83/28 383/120 |

OTHER PUBLICATIONS

Custom Packaging Products Boxes Design Handle Boxes. [online] Published on Nov. 29, 2017. Retrieved Jun. 25, 2020 from URL: http:// customproductsboxes .blogspot.com/2017 /11 /handle-boxes-are-one-of-our-creations. html.

* cited by examiner

HEAVY DUTY PACK AND METHOD OF MANUFACTURING

CROSS-REFERENCE TO RELATED APPLICATION

The present application claims the benefit under 35 U.S.C. 119 of U.S. Provisional Patent Application No. 62/845,587, filed May 9, 2019, which is incorporated by reference herein.

FIELD OF THE INVENTION

The present invention relates to heavy duty retail packaging.

SUMMARY OF THE INVENTION

An aspect of the invention involves a heavy duty pack comprising a main body including a front, a rear, a bottom, and opposite sides that join the front, the rear, and the bottom; a top section including a flat flange with a front panel and a back panel, and angled sections that join the main body to the flat flange, wherein the flat flange includes opposite ends with respective seals adjacent thereto securing the front panel and the back panel together adjacent to the opposite ends.

One or more implementations of the aspect of the invention described above includes one or more of the following: the seals are vertically elongated seals; the seals are oval seals; both the front panel and the back panel of the flat flange include a first outer ply and a second inner ply, the second inner ply of both the front panel and the back panel of the flat flange include holes where the seals are formed between the first outer ply of both the front panel and the back panel; the seals are laser welded seals; the top section includes a two-piece plastic handle within the flat flange; the two-piece plastic handle includes an oval configuration; the two-piece plastic handle includes a grip section with four finger recesses; the two-piece plastic handle includes a first handle member and a second handle member that together include spaced protruding connector pegs and spaced peg receivers that mate with each other to clamp the handle onto the front panel and the back panel of the top section; both the front panel and the back panel of the flat flange include a first outer ply and a second inner ply, and the pegs extend through both the first outer ply and a second inner ply of the front panel and the first outer ply and a second inner ply of the back panel; and/or the first handle member and the second handle member include rear sides that are affixed to the front panel and the back panel of the top section to additionally secure the handle to the top section.

Another aspect of the invention involves a method of manufacturing the heavy duty pack of the aspect of the invention described above, wherein both the front panel and the back panel of the flat flange include a first outer ply and a second inner ply, the second inner ply of both the front panel and the back panel of the flat flange include holes, and the method comprises aligning the holes of the first outer ply and the second inner ply of the flat flange; and sealing the first outer ply of both the front panel and the back panel together through the aligned holes of the first outer ply and the second inner ply.

One or more implementations of the aspect of the invention described immediately above includes one or more of the following: sealing includes laser welding the first outer ply of both the front panel and the back panel together through the aligned holes of the first outer ply and the second inner ply; the seals are vertically elongated seals; the seals are oval seals; the top section includes a two-piece plastic handle within the flat flange, and the method further comprises adding the two-piece plastic handle within the flat flange; the two-piece plastic handle includes an oval configuration; the two-piece plastic handle includes a grip section with four finger recesses; the two-piece plastic handle includes a first handle member and a second handle member that together include spaced protruding connector pegs and spaced peg receivers, and the method further comprises mating the spaced protruding connector pegs and spaced peg receivers with each other, through the front panel and the back panel of the flat flange, to clamp the handle onto the front panel and the back panel of the top section; and/or the first handle member and the second handle member include rear sides, and the method further comprises affixing the rear sides of the first handle member and the second handle member to the front panel and the back panel of the top section to additionally secure the handle to the top section.

BRIEF DESCRIPTION OF DRAWINGS

The accompanying drawings, which are incorporated in and form a part of this specification illustrate embodiments of the invention and together with the description, serve to explain the principles of the invention.

DESCRIPTION OF EMBODIMENT OF THE INVENTION

Figure 1:
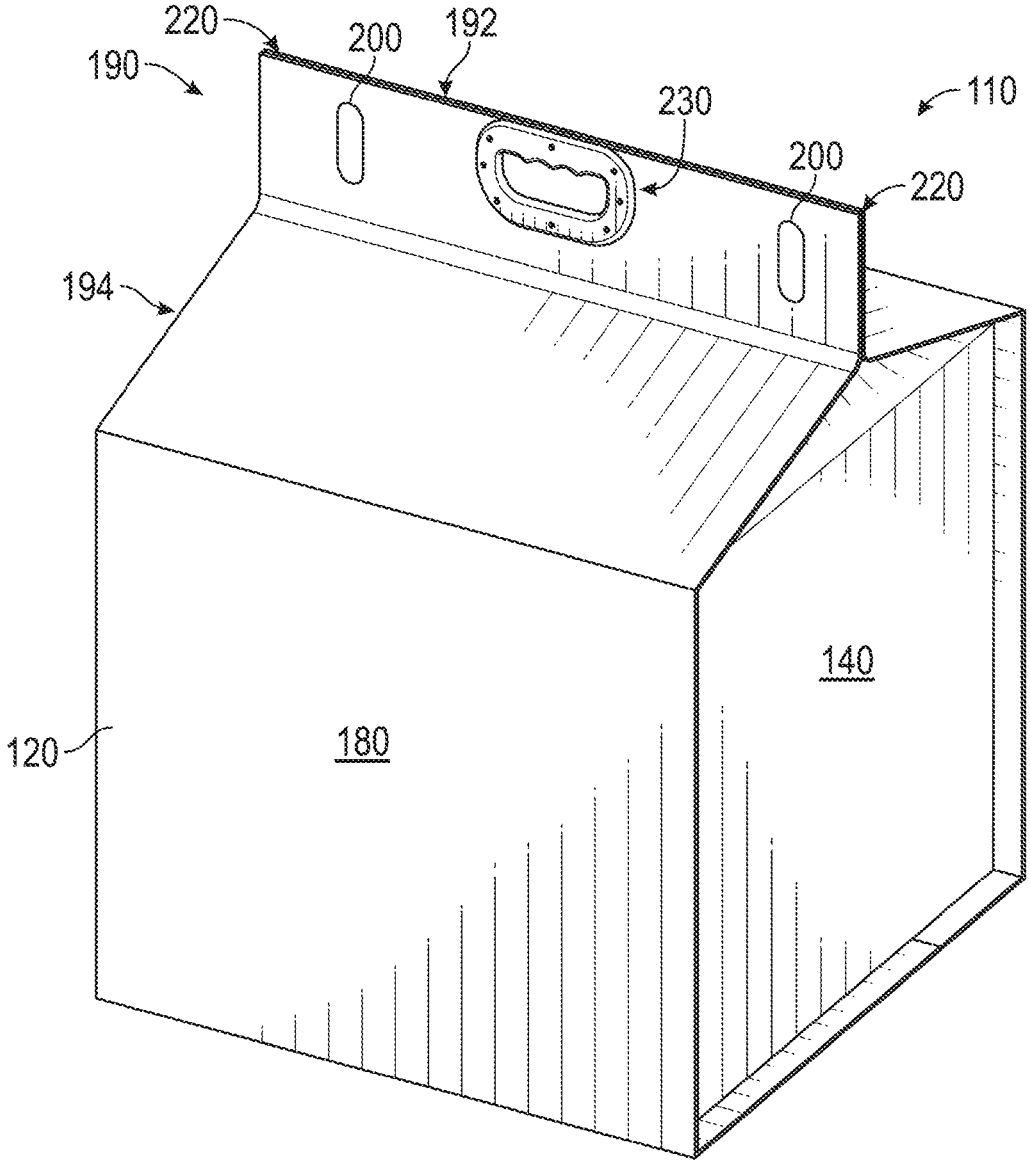
FIG. 1 is a perspective view of an embodiment of a heavy duty pack.
Figure 2:
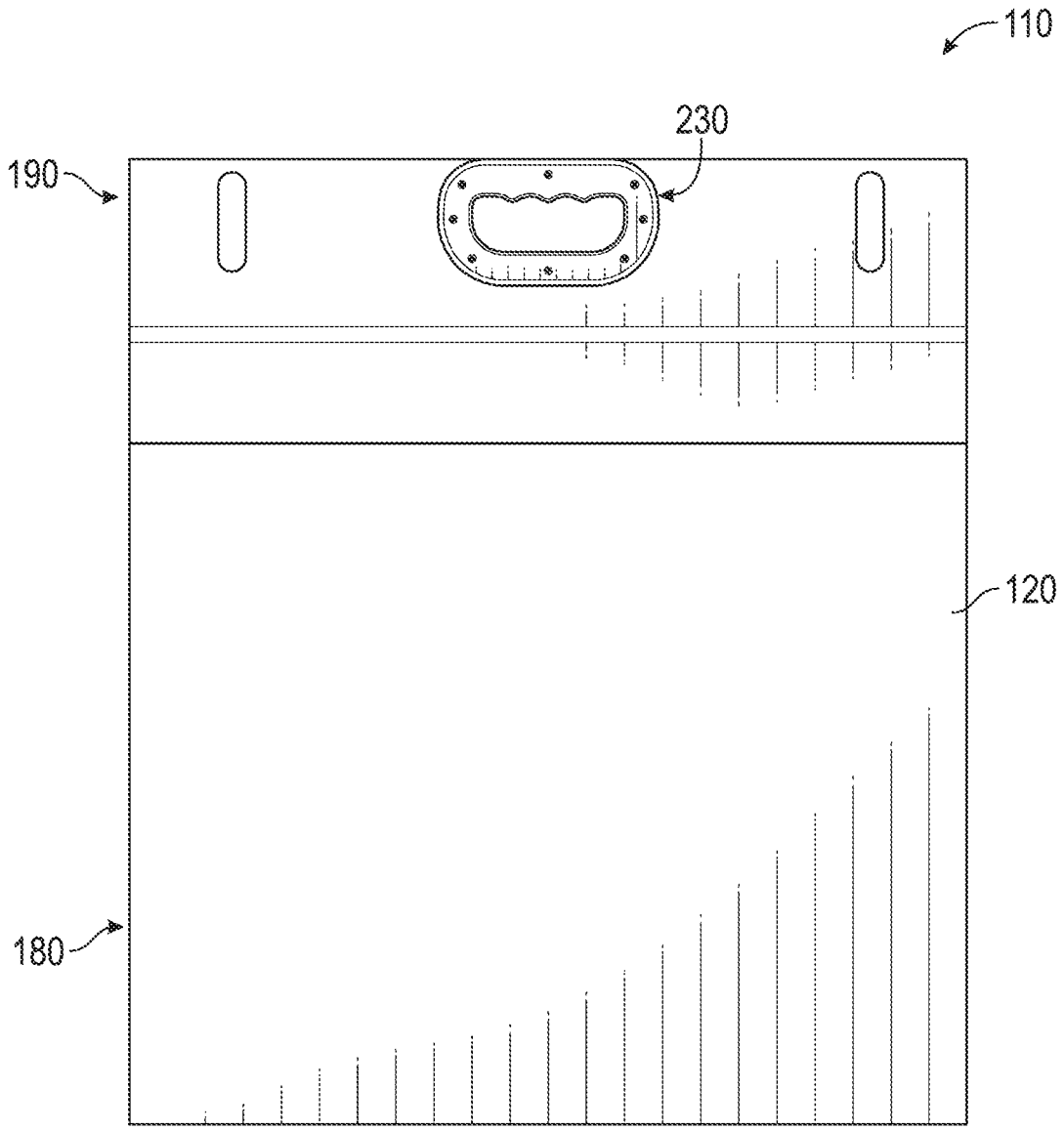
FIG. 2 is a front elevation view of the heavy duty pack of FIG. 1.
Figure 3:
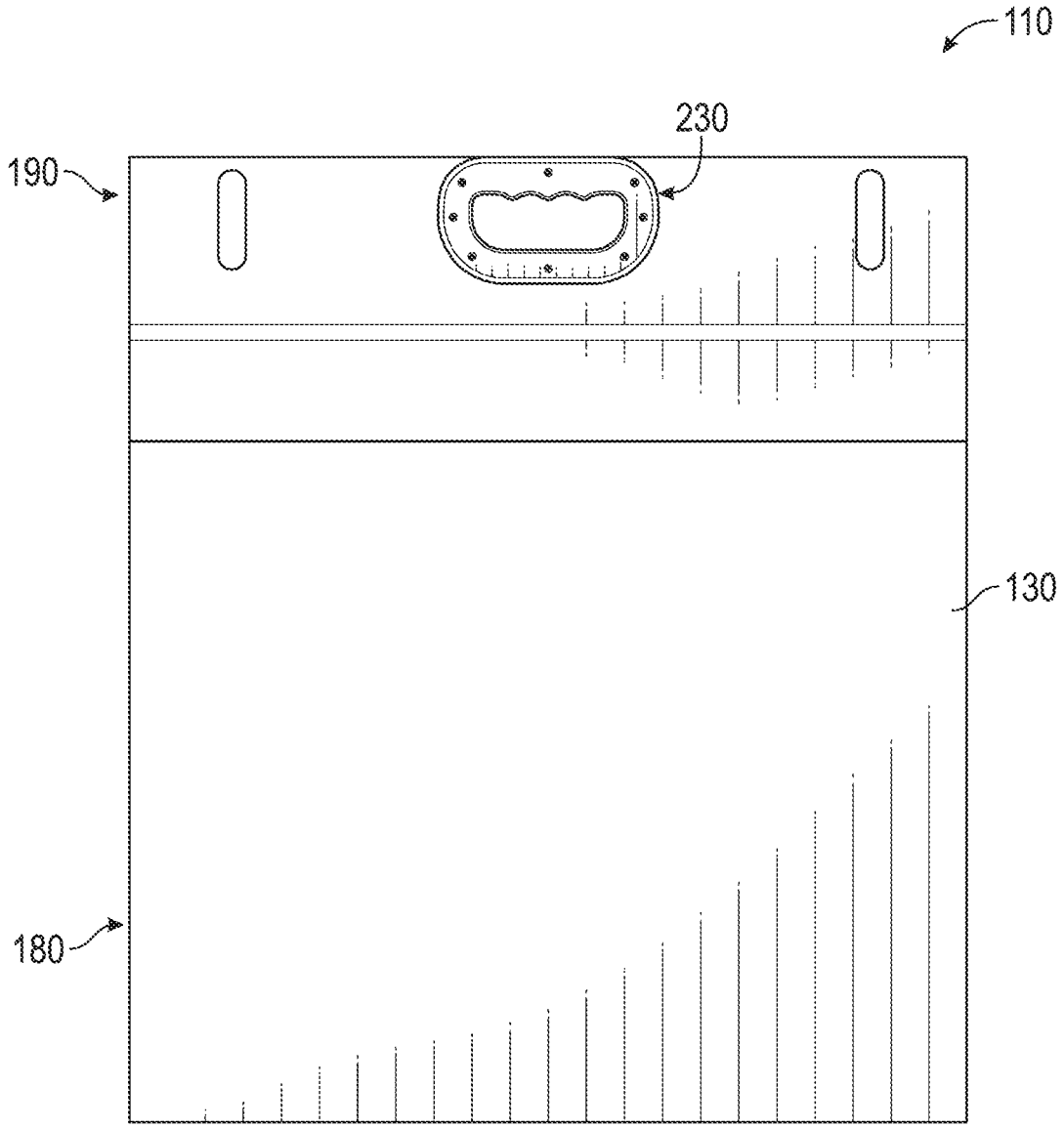
FIG. 3 is a rear elevation view of the heavy duty pack of FIG. 1.
Figure 4:
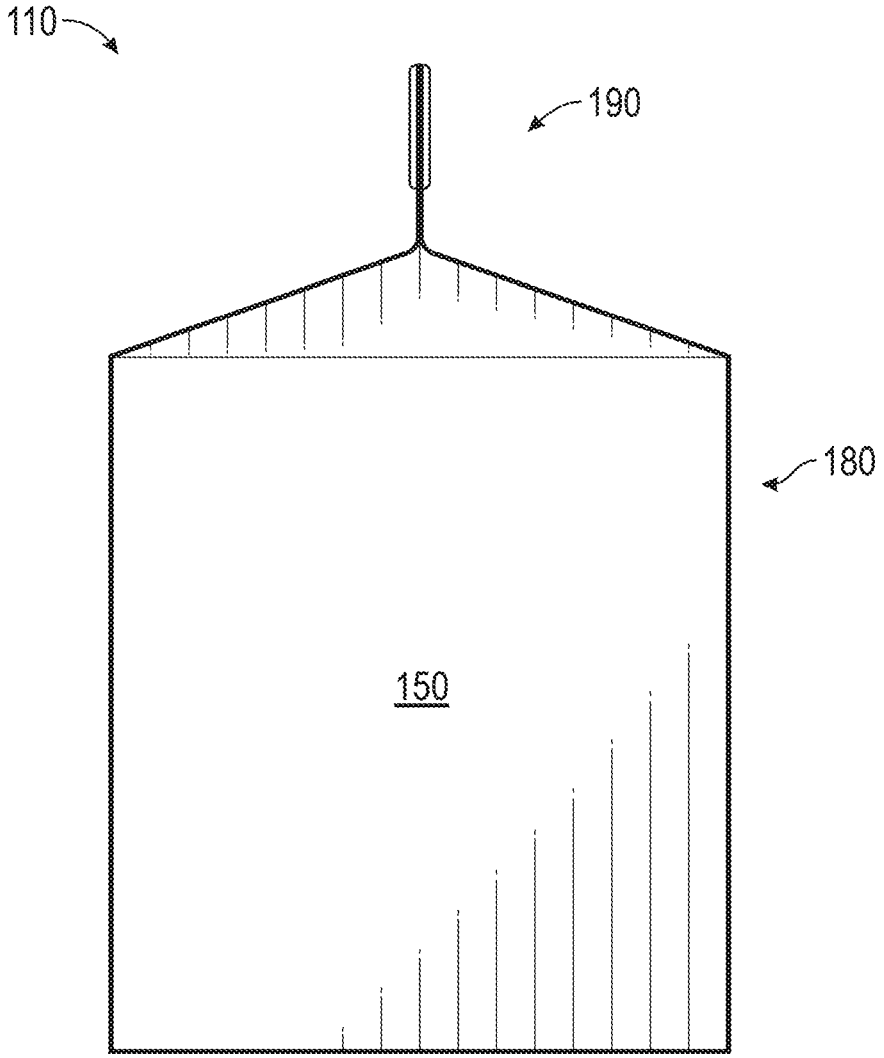
FIG. 4 is a left side elevational view of the heavy duty pack of FIG. 1.
Figure 5:
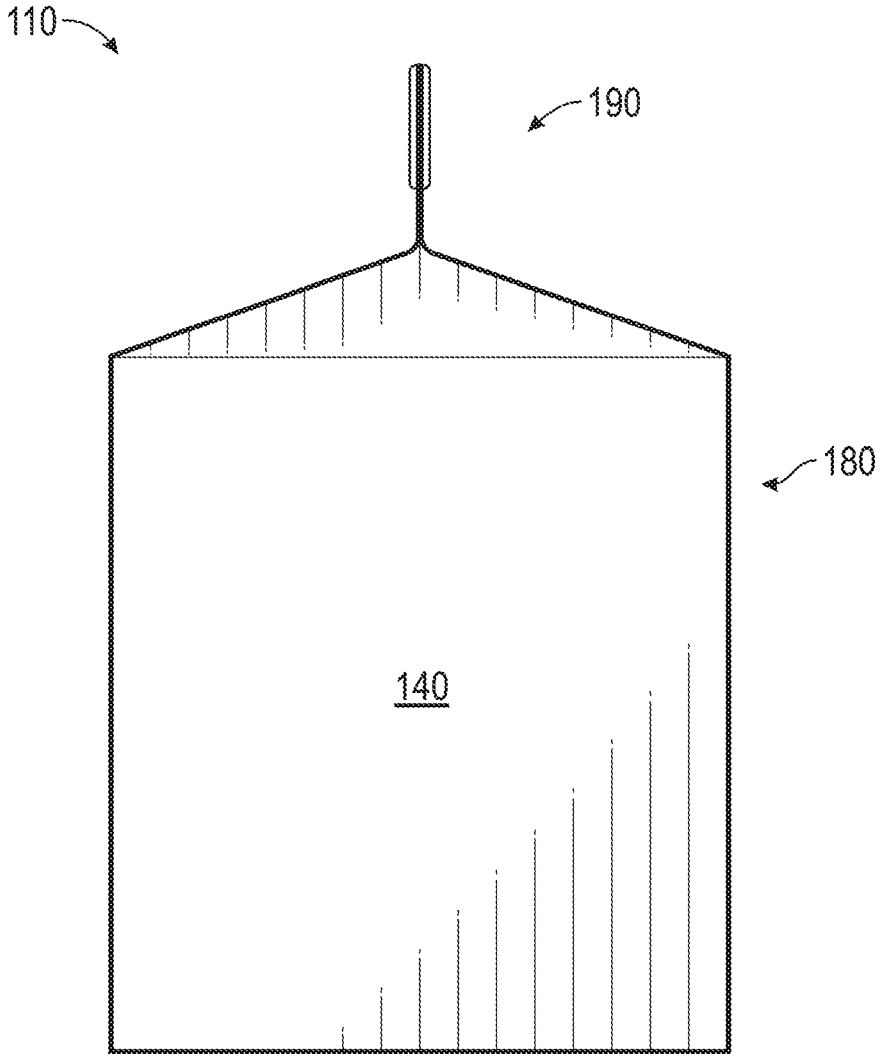
FIG. 5 is a right side elevational view of the heavy duty pack of FIG. 1.
Figure 6:
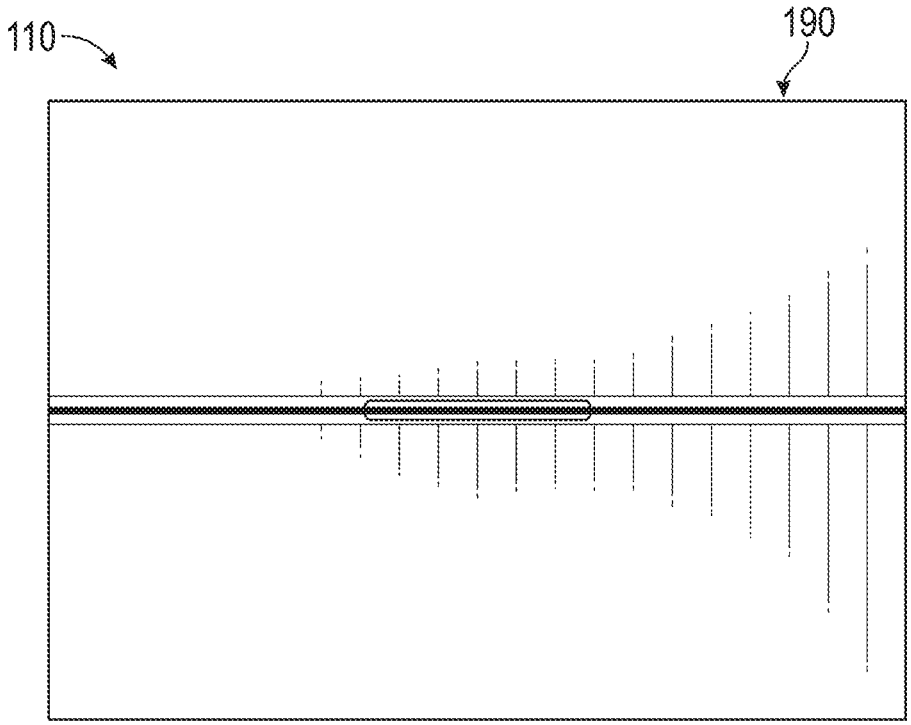
FIG. 6 is a top plan view of the adjustable cyclic device of FIG. 1.
Figure 7:
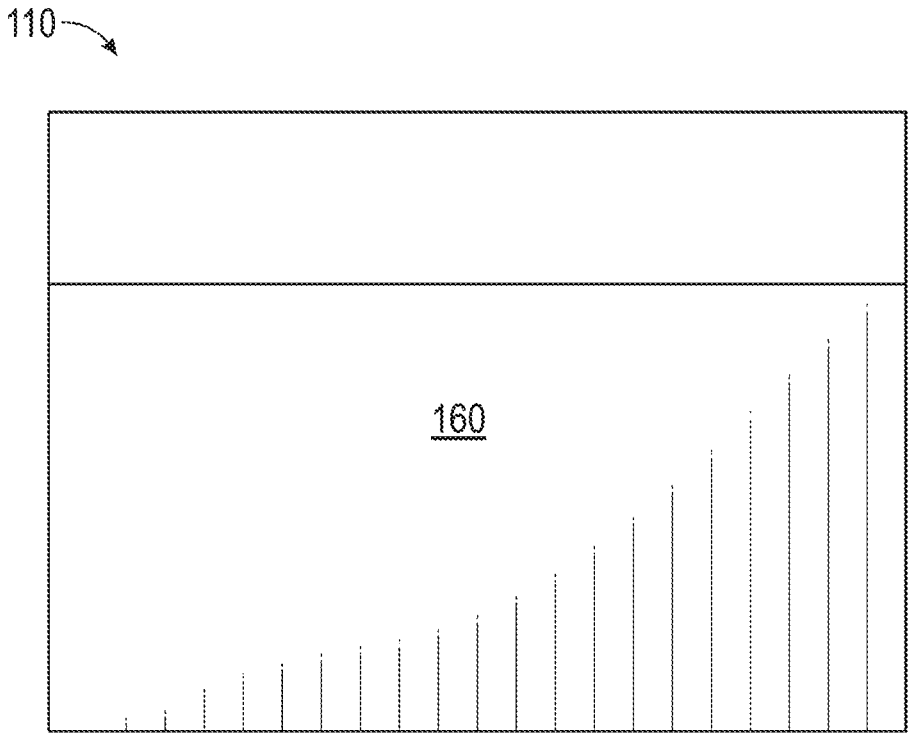
FIG. 7 is a bottom plan view of the heavy duty pack of FIG. 1.

With reference to FIGS. 1-16, an embodiment of a heavy duty pack ("pack") 110 will be described. The pack 110 may be used, for example, but not by way of limitation, as retail packaging for water softener salt bars.

The pack 110 includes a front panel 120, a back panel 130, side panels 140, 150, and a bottom 160 that are dual plied and are laser welded at edges to form the pack 110. The pack 110 includes an internal cavity that holds for example, but not by way of limitation, the water softener salt bars. The pack 110 includes a main body 180 and a top section 190 with a flat flange 192 and angled sections 194.

Figure 8:
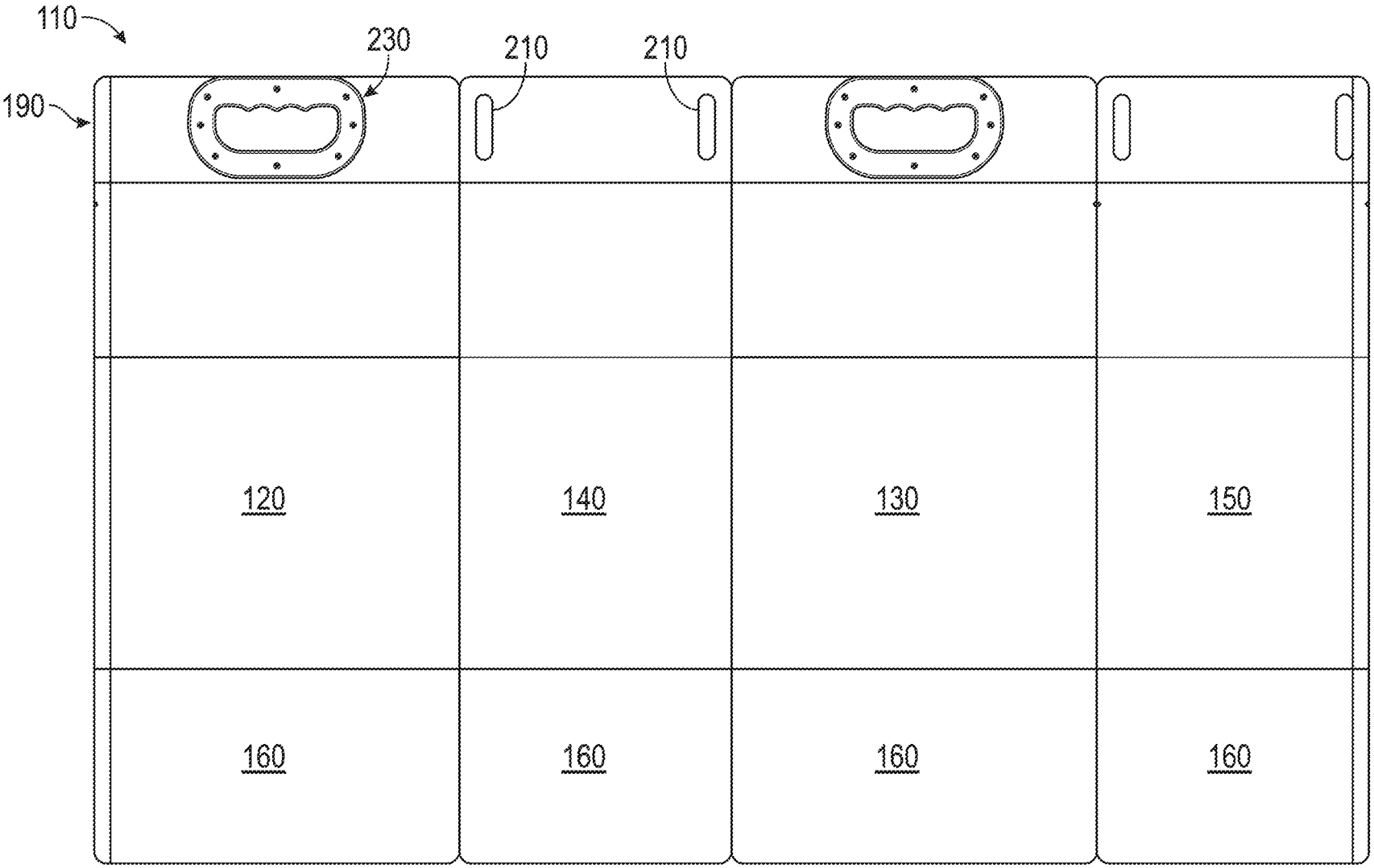
FIG. 8 is a front-elevational view of an embodiment of a template for the heavy duty pack shown in FIGS. 1-7.
Figure 9:
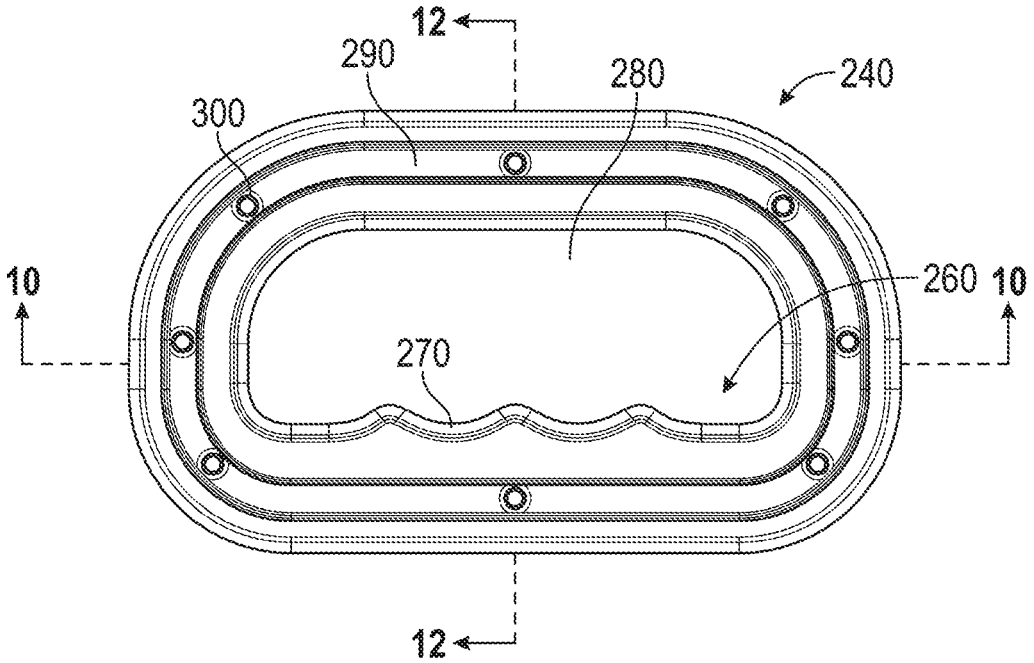
FIG. 9 is a front elevational view of an embodiment of a first handle member for the heavy duty pack shown in FIGS. 1-8.
Figure 10:
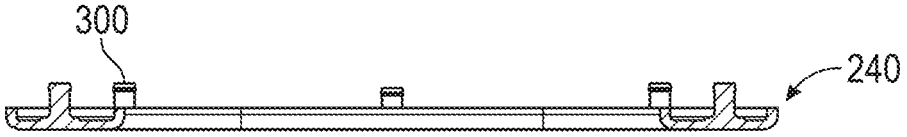
FIG. 10 is a cross-sectional view of the first handle member of FIG. 9 taken along lines 10-10.
Figure 11:
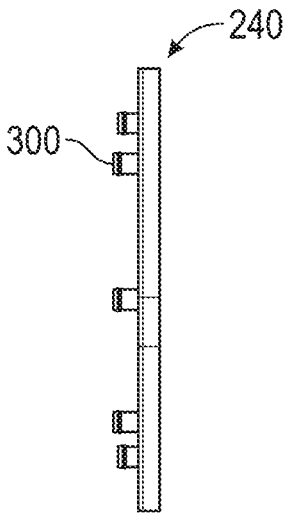
FIG. 11 is a side elevational view of the first handle member of FIG. 9.
Figure 12:
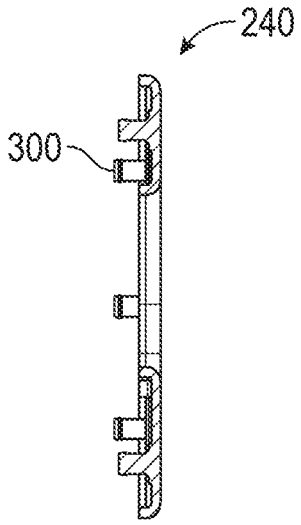
FIG. 12 is a cross-sectional view of the first handle member of FIG. 9 taken along lines 12-12.
Figure 13:
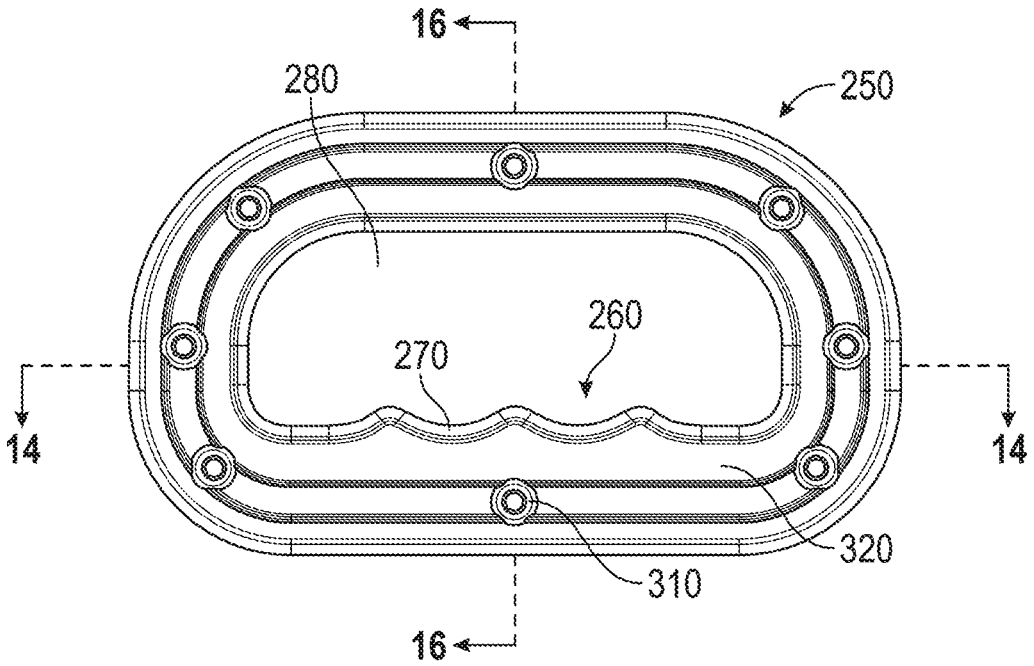
FIG. 13 is a front elevational view of an embodiment of a second handle member for the heavy duty pack shown in FIGS. 1-8.
Figure 14:
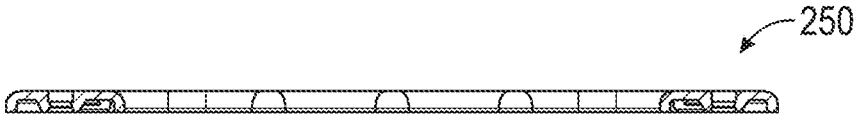
FIG. 14 is a cross-sectional view of the second handle member of FIG. 13 taken along lines 14-14.
Figure 15:
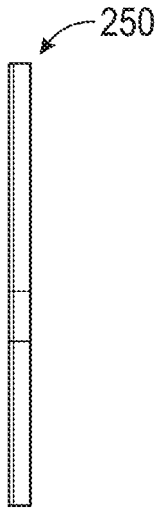
FIG. 15 is a side elevational view of the second handle member of FIG. 13.
Figure 16:
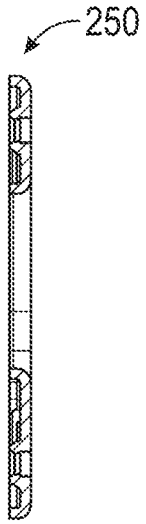
FIG. 16 is a cross-sectional view of the second handle member of FIG. 13 taken along lines 16-16.

The top section 190 includes vertically elongated oval seals 200 to affix the front panel 120 and the back panel 130 of the top section 190 together, giving the top section 190 the appearance shown and strengthening the top section 190. FIG. 8 shows vertically elongated punch outs/cutouts 210 that, because the top section 190 is dual-plied, form openings in side gussets 220 of the top section 190 behind the front panel/layer 120 and back panel/layer 130 to allow front panel/layer 120 and back panel/layer 130 to bond during laser welding to form the vertically elongated oval seals 200.

The top section 190 further includes two-piece plastic handle 230 in flat flange 192. The plastic handle 230 includes a first handle member 240 and a second handle member 250. The first handle member 240 and a second handle member 250 have a generally oval configuration, and include a grip section 260 with four finger recesses 270 along with a main recess 280 for hand grip by a user. The first handle member 240 includes a rear 290 with eight spaced rearwardly protruding connector pegs 300 that mate with eight spaced peg receivers 310 along a rear 320 of the second handle member 250 to clamp the handle 230 onto the front panel 120 and the back panel 130 of the top section 200. The pegs 300 extend through the 2×2 plies of the front panel 120 and the back panel 130 of the top section 200 with a cut-out in the front panel 120 and the back panel 130 for the finger recesses 270 and the main recess 280 of the handle 230. The rears 290, 320 of the first handle member 240 and the second handle member 250 may also be affixed to the front panel 120 and the back panel 130 of the top section 200 to additionally secure the handle 230 to the top section 200.

The figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

I claim:

1. A heavy duty pack, comprising:

a main body including a front, a rear, a bottom, and opposite sides that join the front, the rear, and the bottom;

a top section including a flat flange with a front panel and a back panel, and angled sections that join the main body to the flat flange;

a two-piece plastic handle having an oval configuration includes a first handle member and a second handle member that together include spaced protruding connector pegs and spaced peg receivers that mate with each other to clamp the handle onto the front panel and the back panel of the top section, the first handle member and the second handle member including rear sides that are affixed to the front panel and the back panel of the top section to additionally secure the handle to the top section;

wherein the flat flange includes opposite ends with respective seals adjacent thereto securing the front panel and the back panel together adjacent to the opposite ends.

2. The heavy duty pack of claim 1, wherein the seals are vertically elongated seals.

3. The heavy duty pack of claim 2, wherein the seals are oval seals.

4. The heavy duty pack of claim 1, wherein the flat flange includes aligned elongated cutouts adjacent to the opposite ends, and the seals are formed through the aligned elongated cutouts.

5. The heavy duty pack of claim 1, wherein the seals are laser welded seals.

6. The heavy duty pack of claim 1, wherein the two-piece plastic handle includes a grip section with four finger recesses.

7. The heavy duty pack of claim 1, wherein the pegs extend through both the front panel and the back panel.

8. A method of manufacturing the heavy duty pack of claim 1, wherein the flat flange includes aligned elongated cutouts adjacent to the opposite ends, and the seals are formed through the aligned elongated cutouts, and the method comprises:

aligning the elongated cutouts of the front panel and the back panel; and sealing the front panel and the back panel together through the aligned elongated cutouts.

9. The method of manufacturing of claim 8, wherein sealing includes laser welding the front panel and the back panel together through the aligned elongated cutouts.

10. The method of manufacturing of claim 8, wherein the seals are vertically elongated seals.

11. The method of manufacturing of claim 10, wherein the seals are oval seals.

12. The method of manufacturing of claim 8, wherein the two-piece plastic handle includes a grip section with four finger recesses.

13. The method of manufacturing of claim 8, wherein the method further comprises mating the spaced protruding connector pegs and spaced peg receivers with each other, through the front panel and the back panel of the flat flange, to clamp the handle onto the front panel and the back panel of the top section.

14. The method of manufacturing of claim 8, wherein the method further comprises affixing the rear sides of the first handle member and the second handle member to the front panel and the back panel of the top section to additionally secure the handle to the top section.

* * * * *